United States Patent [19]

Siemers et al.

[11] Patent Number: 4,981,643

[45] Date of Patent: Jan. 1, 1991

[54] HIPING METHOD FOR COMPOSITE STRUCTURES

[75] Inventors: Paul A. Siemers, Clifton; Stephen F. Rutkowski, Duanesburg, both of N.Y.

[73] Assignee: General Electric Company, Schenectady, N.Y.

[21] Appl. No.: 546,228

[22] Filed: Jun. 29, 1990

[51] Int. Cl.[5] ..... B22F 1/00

[52] U.S. Cl. ..... 419/17; 419/10; 419/49; 75/229; 75/236

[58] Field of Search ..... 719/10, 17, 49; 75/229, 75/236

[56] References Cited

U.S. PATENT DOCUMENTS

| | | | |
|---|---|---|---|
| 4,305,449 | 12/1981 | Loszewski et al. | 419/49 |
| 4,659,548 | 4/1987 | Gubbay et al. | 419/10 |
| 4,749,545 | 6/1988 | Begg | 419/17 |

*Primary Examiner*—Stephen J. Lechert, Jr.

*Attorney, Agent, or Firm*—Paul E. Rochford; James C. Davis, Jr.; James Magee, Jr.

[57] ABSTRACT

A method for improved HIPing of filament reinforced metal matrix composite samples is disclosed. The method departs from conventional HIPing practice in that it does not rely on the heating of the HIPing gas in order to increase pressure. Rather, the temperature of the article and of the HIPing gas is first to the HIPing temperature and the pressure of the gas and the pressure on the sample is then raised to the HIPing pressure. Benefits are derived in that a lower level of filament fracture results.

6 Claims, 1 Drawing Sheet

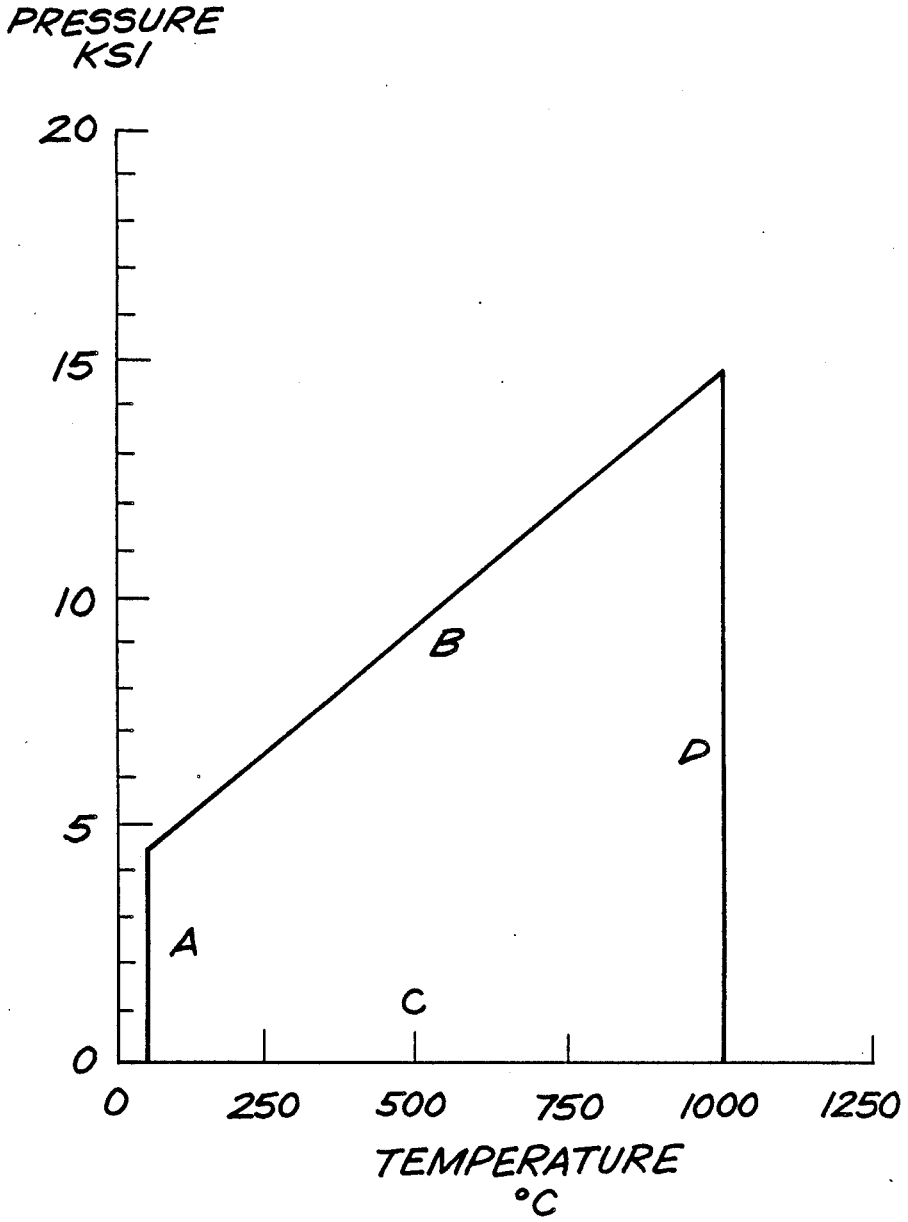
PRESSURE
KSI
20
15
10
5
0
A
B
C
D
0
250
500
750
1000
1250
TEMPERATURE
°C

HIPING METHOD FOR COMPOSITE STRUCTURES

CROSS REFERENCE TO RELATED APPLICATIONS

The present invention relates closely to copending application Ser. No. 546224, filed June 29, 1990. The text of the copending application is incorporated herein by reference.

BACKGROUND OF THE INVENTION

The present invention relates generally to the HIPing of composite structures. More particularly it relates to improvement in the HIPing of a composite structure in which a grid of reinforcing elements is embedded within a metal matrix.

The present invention is directed particularly to improving the product formed by HIPing a composite structure in which fine filaments of reinforcement are embedded within a matrix of metal which has been deposited by plasma spray technique.

The formation of composite structures having filaments of reinforcing material such as aluminum oxide fibers or silicon carbide fibers embedded within a metal matrix, such as a titanium base matrix, have been disclosed in the art.

The preparation of titanium alloy base foils, sheets, and similar articles and of reinforced structures in which silicon carbide fibers are embedded in a titanium base alloy are described in U.S. Pat. Nos. 4,775,547; 4,782,884: 4,786,566; 4,805,294; 4,805,833; and 4,838,337; assigned to the same assignee as the subject application. The texts of these patents are incorporated herein by reference. Preparation of composites as described in these patents is the subject of intense study inasmuch as the composites have very high strength properties in relation to their weight. One of the properties which is particularly desirable is the high tensile properties imparted to the structures by the high tensile properties of the reinforcing fibers or filaments. The tensile properties of the structures are related to the rule of mixtures. According to this rule the proportion of the property, such as tensile property, which is attributed to the filament, as contrasted with the matrix, is determined by the volume percent of the filament present in the structure and by the tensile strength of the filament itself. Similarly, the proportion of the same tensile property which is attributed to the matrix is determined by the volume percent of the matrix present in the structure and the tensile strength of the matrix itself.

Prior to the development of the processes described in the above-reference patents, such structures were prepared by sandwiching the reinforcing filaments between foils of titanium base alloy and pressing the stacks of alternate layers of alloy and reinforcing filament until a composite structure was formed. However, that prior art practice was found to be less than satisfactory when attempts were made to form shaped structures in which the filament was an internal reinforcement for the entire shaped structure.

The structures taught in the above-referenced patents and the methods by which they are formed, greatly improved over the earlier practice of forming sandwiches of matrix and reinforcing filament by compression.

Later it was found that while the structures prepared as described in the above-referenced patents have properties which are a great improvement over earlier structures, the attainment of the potentially very high ultimate tensile strength of these structures did not measure up to the values theoretically possible. The testing of the composites formed according to the methods taught in the above patents has demonstrated that although modulus values are generally in good agreement with the rule of mixtures predictions, the ultimate tensile strength is usually much lower than predicted by the underlying properties of the individual ingredients to the composite. A number of applications have been filed which are directed toward overcoming the problem of lower than expected tensile properties and a number of these applications are copending. These include applications Ser. No. 445,203 pending November 13, filed Dec. 4, 1989; Ser. No. 459,894, filed Jan. 2, 1990, U.S. Pat. No. 4,978,585 and Ser. Nos. 455,041 and 455,048 pending November 13 both filed Dec. 22, 1989. The texts of these applications are incorporated herein by reference.

One problem which we have encountered in forming complex structures is the problem of filament breakage. Some of the patents referenced above, and particularly the U.S. Pat. Nos. 4,786,566 and 4,782,884, teach a method by which monotapes can be formed. Such monotapes constitute a planar structure in which an array of parallel reinforcing filaments are embedded in a titanium base matrix metal. According to the patents referenced above, the embedding of the reinforcing filament within the titanium base matrix is accomplished by plasma spray depositing the titanium base matrix about the filaments. Such plasma spray depositing has been very effective in embedding the filament because the droplets of spray are essentially liquid at the time they contact the filament reinforcement and damage to the filaments in a formation of the single ply monotapes is accordingly minimal. However, when a number of such tapes are mounted together and a HIPing consolidation is applied thereto, there is a tendency toward breakage of the embedded filament. Primarily it is thought because of the irregularities of the surface of the spray deposited titanium base matrix metal. Such irregularities are thought to generate point contact stresses in embedded filaments and to cause cracking and other damage thereto. The irregularities at the surface of the plasma spray deposited matrix metal is a by-product of the plasma spray process itself. It is therefore an advantage to employ the as-deposited matrix in forming composite structures because of the lower cost of employing the monotapes in the as-formed condition.

We have found that the damage to the embedded fibers occurs principally when planar multilayer structures are formed by compression or by HIP consolidation.

The HIP consolidation of composite structures is a well known process and its practice has been applied to many different structures. As noted above, it can be employed in the fiber and foil type of consolidation as well as in the consolidation of a product which is initially solid and coherent to increase the density of the composite and to reduce the proportion of voids therein.

As noted above, one of the problems which is associated with formation of filament reinforced metal structures which are prepared by methodologies which include a HIPing consolidation step is the problem of filament breakage. The filaments which are employed to strengthen composite metal products are generally high strength ceramic base products. These products have extremely high tensile properties along their length, but because they are ceramic in nature, they are highly subject to breakage due to point contact stresses and strain. A simple way in which a determination can be made of the effectiveness of processing steps in preserving the integrity of elementary reinforcement and in reducing the degree to which such filamentary reinforcement are subject to breakage is by dissolving away the matrix metal following the processing in order to determine by visual observation the degree to which the reinforcing filament has been cracked and broken. It has been observed from such testing that a significant part of the breakage which occurs, occurs as the composite structure is consolidated by an action such as the HIPing action.

BRIEF DESCRIPTION OF THE INVENTION

It is accordingly one object of the present invention to reduce the degree of filament breakage which results from consolidation of filament reinforced metal matrix structures.

Another object is to provide a method by which composite structures having a filament reinforcement within a metal matrix can be strengthened and improved.

Another object is to provide a method which forms an improved composite structure having filament reinforcement within a metal matrix.

Other objects and advantages of the present invention will be in part apparent and in part pointed out in the description which follows:

In one of its broader aspects, objects of the present invention can be achieved by forming the HIPing consolidation by an unconventional sequence of steps. The sequence involves first the raising of the temperature of the HIPing medium and of the article to be consolidated to the HIPing temperature. After the article and medium are at the HIPing temperature, the HIPing pressure is applied to cause the consolidation.

BRIEF DESCRIPTION OF THE DRAWINGS

The detailed description which follows will be understood with greater clarity if reference is made to the accompanying drawings in which:

FIG. 1 is a graph which plots the HIPing temperature against the HIPing pressure.

DETAILED DESCRIPTION OF THE INVENTION

The conventional prior art HIPing process involves raising the pressure of the HIPing medium to a value below the final pressure. The pressure is raised by pumping the medium into the HIPing chamber until the desired pressure is reached. The practice is conventional because the pumping of a medium at a lower pressure puts less strain on the pumping equipment.

After the pressure of the HIPing medium has been raised to the desired point, the temperature is increased and as a result of the operation of Boyle's law, the increase in the temperature results in increase in pressure of the medium. Thus, by raising the temperature of the compressed medium, the degree of compression increases and the pressure increases so that the article to be consolidated is subjected to progressively increased pressure as the temperature of the article is increased.

The operation of the HIPing apparatus in this prior art fashion can be described with reference to the accompanying FIGURE.

Referring now to the FIGURE, the pressure is plotted as the ordinate in ksi and temperature is plotted as the abscissa in degrees centigrade. The conventional HIPing practice is carried out by first increasing the pressure of the HIPing medium. Normally this is a gas and the gas pressure is increased by pumping more gas into the HIPing chamber. Line A of the FIGURE represents the increase in pressure as the HIPing chamber is filled with more and more gas. After the known quantity of gas has been introduced into the chamber and the pressure has reached a preset mark of about 4000 to 5000 psi, or 4 or 5 ksi, the pumping action is stopped and the heating cycle is started. As is well known, the pressure of a gas in a contained vessel increases as the temperature of the gas increases. Accordingly, the pressure and temperature of the gas in the HIPing chamber approximately follow line B of the FIGURE as heat is put into the gas and the temperature of the gas increases and the pressure of the gas also increases pursuant to Boyle's law.

In carrying out the HIPing process, it is desired to establish and maintain a certain pressing and heating history. Thus in general in order to be a reproducible process, the history of the heating and of the pressure should be repeated from one HIPing operation to the next. Because of this need to have a consistent history from one HIPing operation to the next and because of the variables which are introduced into a HIPing operation because of the different geometries of the different samples which are HIPed, there is a need during the part of the cycle represented by line B to make adjustments in the pressure of the gas by some auxiliary pumping or venting in order to follow the proper pressure-temperature-time profile and to establish the proper history.

At the end of the heating cycle, the gas and the sample to be HIPed reach a temperature of about 1000° C. and the pressure reaches a value of about 15 ksi. The temperature and pressure are maintained for a period which may vary from an hour to four hours during which the pressure acts isostatically on the sample to be HIPed as the temperature is maintained at the set value of about 1000° C. This process has the advantage that it reduces the time the part is at elevated temperature. In other words, the conventional practice has the advantage that the increase in temperature is employed to increase the pressure of the HIPing gas medium so that there is no need to try to pump the gas while the part is at elevated temperature. In effect, there is essentially no pumping of gas at elevated temperature as the high pressure is achieved simply by increasing the temperature of the contained gas.

The practice which is employed pursuant to the present invention contrasts with the conventional practice in that the inventive practice requires the pumping of gas while the part is at high temperature.

Pursuant to the present invention a different mode of HIPing is carried out as follows. The first step of the process involves heating of the gas and sample. This heating is carried out preferably before any pressure is applied so that the sample and gas are first heated to a temperature of about 1000° C. With reference to the FIGURE, this heating operation is represented by the movement of the temperature along the line C.

Following the heating of the gas to the chosen temperature, the pressure of the gas is increased. This increase in pressure is represented by the movement of pressure along the line D of the FIGURE. With reference again to the FIGURE, it will be noted that the combination of HIPing temperature and pressure is essentially the same for both practices. Thus each HIPing operation is carried out at about 1000° C. and about 15 ksi.

The important distinction is that according to the present invention pressure is applied to a sample only after it has been heated to about 1000° C. or to what ever HIPing temperature is to be employed.

A very significant advantage results from the operation of the HIPing process according to this invention. We have found that there is significantly less filament breakage when the HIPing operation is carried out pursuant to the present invention than when the HIPing practice is carried out employing a conventional HIPing process. With reference to the FIGURE, this means that the practice which involves a change in temperature and pressure along lines A and B of the FIGURE results in significantly greater filament breakage than that which occurs when the HIPing is carried out with temperature and pressure changes represented by movement along lines C and D.

The benefit of HIPing pursuant to the present invention is made clearer by experience gained from the following practice.

EXAMPLE

A first point of interest is whether the fabrication of monotapes is a cause of filament breakage. The following test showed that this was not the case. Steel drums having a diameter of about 7 inches and width of 5.5 inches were prepared. The drums were wrapped with a molybdenum foil having a thickness of 0.001 inches. The foil wrapped drums were wound with SCS-6 SiC filament obtained from Textron Specialty Materials Company of Lowell, Mass. The spacing of the filament was about 120 filaments per inch. A layer of titanium base alloy and specifically Ti6242 was low pressure r.f. plasma sprayed onto the filament wound drums. The Ti6242 is an alloy of titanium containing 6 weight percent aluminum, 2 weight percent tin, 4 weight percent zirconium and 2 weight percent molybdenum. The monotape prepared in this fashion was removed from the drums and cut into four pieces. Each piece was 4 inches wide and 5 inches long with the fibers running perpendicular to the 4 inch dimension.

In order to check the condition of the fibers, the fibers were extracted from the monotape by dissolving the matrix Ti6242 in nitric acid-hydrofluoric acid-water solution. After the dissolution of the matrix, all other remaining SiC fibers were the original length of the monotape. It was concluded that this process did not appreciably damage the fibers.

A fiberless foil was also fabricated by spraying a like amount of Ti6242 matrix metal onto a drum that had been wrapped with molybdenum foil but from which the filament was absent. The fiberless foil was cut into pieces measuring 4 inches by 5 inches.

To test the effect of the HIPing on the fiber within the monotape, a composite panel was fabricated. The fabrication involved laying 4 successive layers of monotape with the smooth side of the monotape in contact with the rough side of the next monotape. After stacking four monotapes, a fiberless foil was added with the smooth side of the fiberless foil in contact with the smooth side of one of the outer monotapes. This arrangement of monotapes is deemed to provide a balanced structure. An alternative fashion in which such monotapes may be assembled is by placing the fiberless foil in the center of the assembly and by having the surfaces of the fiberless foil in contact with the smooth sides of the two monotapes adjacent to it. The assembly as first described above was sandwiched between two foils of molybdenum measuring 4½ by 5½ inches with a thickness of about 0.001 inch. The assembly of the monotapes with the molybdenum foils was in turn sandwiched between two 0.062 inch steel plates measuring 5 by 6 inches. These plates formed the outer surface of a HIP can. Conventional arrangements were made to evacuate and seal the HIP can prior to HIPing. The can with these contents was introduced into a HIPing chamber. Prior to heating the can, the pressure in the chamber was raised to about 4,000 psi. This was followed by a heating of the gas within the chamber as well as the contents of the chamber and specifically the HIPing can and its contents. During the heating, the pressure and temperature increased linearly to the desired final values of about 15,000 psi. The HIP can was held at the 15,000 psi pressure for three hours at 900° C. temperature.

Following the HIPing, the HIP can and its contents were removed from the chamber and the steel can and the molybdenum foils were dissolved in a 50% nitric/50% water solution. Several 0.5 by 4 inch strips of composite were diamond cut from the composite panel. The cuts being made parallel to the length of the fibers. Ti6242 matrix material was dissolved from one of the specimens using a nitric acidhydrofluoric acid-water mix. After dissolution, only 10 to 5% of the extracted fibers had the original fiber length of about 4 inches. It was concluded that a large percentage of the fibers had been broken by the HIPing operation. Tensile tests were performed on other specimens that had been removed from the same panel. The measured tensile properties were below the expected rule of mixtures values. It was concluded that a large percentage of the broken fibers in a composite can lead to degraded tensile properties.

Another series of monotapes and fiberless foils were fabricated, cut, stacked and sealed in HIP cans using the same procedures as described immediately above. However, in this case, the HIP procedure was modified. Instead of prepressurizing the HIP unit prior to heating, the HIP unit was pressurized to only 100 psi, the minimum pressure permitted for operation of the unit. The HIP chamber and its contents were heated to about 900° C. After achieving the 900° C. temperature, the HIP unit was pressurized to 15,000 psi and was held at that pressure for three hours.

The analytical procedure following the HIPing was similar to that performed on the can which had been conventionally HIPed as described above. In other words, after HIPing, the can was removed from the composite panel by dissolution in acid and cut into specimens having dimensions of about ½ inch by 4 inches. When the matrix titanium base alloy had been removed by dissolution, it was observed visually that almost all of the fibers were about 4 inches long. The fibers which were shorter than the 4 inch dimension were believed to have been slightly misaligned and to have been cut during the specimen machining process. It was concluded that the modified HIPing procedure which involved heating the specimen to be HIPed and the HIPing medium to the HIPing temperature prior the application of the HIPing pressure was essential to minimizing fiber breakage during HIPing. Tensile tests were performed on the remaining specimen and it was found that the tensile strength of the specimens approached rule of mixture predictions closely.

The combination of time, temperature, and pressure will vary depending on the composite to be HIP'd and particularly on the alloy of the matrix of the composite. A workable combination and a preferred combination can be determined by a few scoping experiments by those familiar with HIPing technology. A suitable combination can thus be prescribed for any specific alloy and composite structure.

What is claimed is:

1. A method of HIPing which comprises providing a metal matrix composite sample to be HIPed, introducing the sample into a HIPing chamber, raising the temperature of the article and HIPing gas to the HIPing temperature, increasing the pressure of the HIPing medium to the HIPing pressure, and maintaining the combination of temperature and pressure for a time prescribed for said composite.

2. The method of claim 1 in which the temperature is raised to at least 800° C.

3. The method of claim 1 in which the pressure is at least 5 ksi.

4. The method of claim 1 in which the sample is a filament reinforced matrix of a titanium base metal.

5. The method of claim 4 in which the filament is silicon carbide filament.

6. The method of claim 4 in which the titanium base alloy is Ti-6242.

* * * * *